United States Patent [19]

Kanbara et al.

[11] 3,947,234

[45] Mar. 30, 1976

[54] METHOD OF RAISING THE TEMPERATURE OF REDUCING GAS CONTAINING CO COMPONENT

[75] Inventors: Kenjiro Kanbara; Masayuki Hattori; Jihei Yoda, all of Himeji, Japan

[73] Assignee: Nippon Steel Corporation, Tokyo, Japan

[22] Filed: Aug. 8, 1974

[21] Appl. No.: 496,026

[30] Foreign Application Priority Data

Aug. 11, 1973 Japan ..... 48-90338
Sept. 1, 1973 Japan ..... 48-98616

[52] U.S. Cl. ..... 432/2; 252/373; 432/29; 23/288 F

[51] Int. Cl.[2] ..... F24D 23/02

[58] Field of Search ..... 432/2, 14, 29, 72, 209, 432/198, 219; 23/288 F; 165/1; 423/415; 252/373

[56] References Cited

UNITED STATES PATENTS

| | | | |
|---|---|---|---|
| 2,441,594 | 5/1948 | Ramseyer | 432/29 |
| 3,351,684 | 11/1967 | Lincoln | 432/2 |
| 3,472,498 | 10/1969 | Price et al. | 432/2 |
| 3,475,510 | 10/1969 | Newman et al. | 252/373 |
| 3,527,288 | 9/1970 | Guthrie | 432/29 |
| 3,768,982 | 10/1973 | Kitzner et al. | 23/288 F |

*Primary Examiner*—John J. Camby
*Assistant Examiner*—Henry C. Yuen
*Attorney, Agent, or Firm*—Toren, McGeady and Stanger

[57] ABSTRACT

A method of raising the temperature of a reducing gas containing a CO component for avoiding the problems caused by soot inevitably generated in raising the temperature of the reducing gas. In heating the reducing gas to a temperature higher than 500°C, the rate of raising the temperature of the reducing gas is kept higher than 350°C/sec. during the time the temperature of the gas is being raised through the range of 500° – 750°C, while the flow velocity of the reducing gas is kept higher than 7 m/sec.

3 Claims, 5 Drawing Figures

METHOD OF RAISING THE TEMPERATURE OF REDUCING GAS CONTAINING CO COMPONENT

BACKGROUND OF THE INVENTION

The present invention relates to a method of raising the temperature of a reducing gas containing a CO component for avoiding the troubles caused by soot inevitably generated in raising the temperature of the reducing gas.

A reducing gas having CO and $H_2$ as its main components controlled at a particular temperature is very useful as a gaseous reducing agent for example, for iron ores. In the operation of a blast furnace, the reducing gas forced into the interior of the blast furnace effectively serves to accomplish the gas reduction of the charged ores so that the lowering of the coke ratio and the improvement in the productivity are achieved. Further, in a method of producing reduced iron other than the blast furnace process, the above described reducing gas is highly useful as a heat source for the reducing furnace and as the gaseous reducing agent. The reducing gas may also be used as an agent for heat-treatment of the reduced iron, such as, a desulfurization, carburizing, or other gaseous treating agent.

Reducing gas used as a gaseous reducing agent or heat-treating agent and having CO and $H_2$ as its main components is obtained in the form of a high temperature reducing gas at a temperature higher than 1000°C, for example, by means of the partial oxidation of a hydrocarbon fuel, steam reforming processes, etc. The high temperature reducing gas is blown into the reducing furnace with the temperature thereof being appropriately adjusted. The amount of the gas used in the reducing furnace is determined by various conditions, such as the volume of the furnace, and the desired results. In any event, large volumes are used. On the other hand, the rate of utilization of the gas in the reducing furnace is far below 100%, and therefore, unused reducing gas, containing $H_2O$ and $CO_2$, is discharged from the top of the reducing furnace is collected and regenerated by a gas circulating system and used again as the gaseous reducing agent. It is necessary to raise the temperature of the thus regenerated reducing gas which has cooled to a lower temperature to a higher blowing temperature needed for the reducing furnace. In the regenerating process for the reducing gas in the above described circulating system, when a catalyst is used, it is necessary to preliminarily raise the temperature of the gas to be treated to a temperature desired for the reforming process. Also, in the case of a low temperature reducing gas obtained by a production process other than that described above, the gas is required to be heated to a temperature desired for the utilization thereof.

In raising the temperature of the reducing gas for the regeneration process described above or for the using it as a gaseous reducing agent, the equilibrium will proceed toward the right in the following equation, when the reducing gas containing a CO component is indirectly heated, $$2\,CO \rightleftarrows CO_2 + C$$

thereby producing carbon (soot) from the gas and generating $CO_2$.

The thus separated soot adheres to the heating tubes so that not only is the heat conducting efficiency lowered, but also, the flow path of the gas is blocked, thereby making it impossible to raise the temperature of the reducing gas. If the reducing gas is processed for the regeneration by using a catalyst, the separated soot adheres to the surface of the catalyst thereby significantly deteriorating the function of the catalyst. Thus, technical measures for prolonging the effective function of the catalyst or quickly changing the catalyst are required. These measures generally disturb the continuous process used to improve the quality of the gas.

SUMMARY OF THE INVENTION

In the present invention, various experiments have been carried out to observe the behaviour of the separating soot from the above described CO containing reducing gas when its temperature is raised so as to find out measures to avoid the above described disadvantages. Thus, the object of the present invention is to make it possible to reduce the amount of soot separated from the CO containing reducing gas while it is flowing within the heating tube. This is accomplished by adopting a particular rate of raising the temperature of the gas within a particular range of heating temperature as well as a particular rate of flow of the gas through the heating tube. The gist of the present invention lies in raising the temperature of the reducing gas at a rate higher than 500°C/sec. when the reducing gas is heated over the temperature of 500°C and particulars when the temperature is being raised in the range of 500° – 750°C, and maintaining the flow velocity of the reducing gas higher than 7 m/sec.

DETAILED DESCRIPTION OF THE PREFERRED EMBODIMENTS

Figure 1:
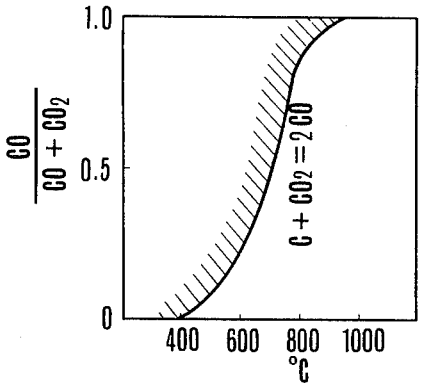
FIG. 1 is an equilibrium diagram showing the relationship of the content of CO in the reducing gas to the temperature thereof.

FIG. 1 shows the equilibrium diagram (Boudouard curve) showing the ratio of CO component in the reducing gas and the temperature thereof. As is clear from FIG. 1, when the temperature of the gas is lower than about 400°C, the total amount consists of $CO_2$ and C. Actually, however, the equilibrium state can not be reached unless the rate of raising the temperature is made extremely low.

Figure 2:
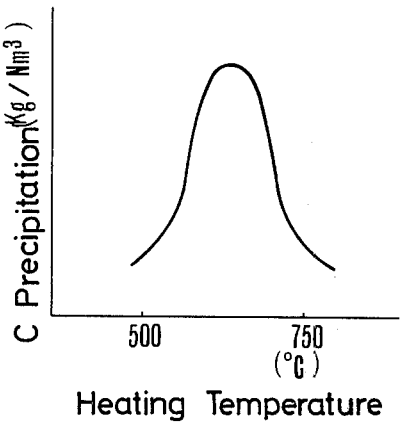
FIG. 2 is a diagram showing the representative pattern of the amount of carbon separated from the CO containing reducing gas when the same is heated.

The present inventors have carried out experiments in which a plurality of samples of the reducing gas containing different contents of CO were tested by raising their temperatures at a substantially constant rate. FIG. 2 shows the diagram of the representative pattern showing the condition of separating carbon (soot) from the reducing gas when the same is heated to various temperatures. As seen from FIG. 2, the gas as it is heated separates various amount of soot depending upon the heating temperature. Particularly, the amount of soot separated from the reducing gas is rapidly increased when the reducing gas is heated to a temperature in the range of 500° – 750°C. The peak of the amount of soot separated from the reducing gas lies at a heating temperature of about 630°C. The height of the peak varies depending upon the ratio of the CO in the heated gas and the height of the peak is proportional to the amount of CO component in the gas.

Together with the separation of soot, a proportionate molar amount of $CO_2$ corresponding to the amount of separated soot is generated.

Figure 3:
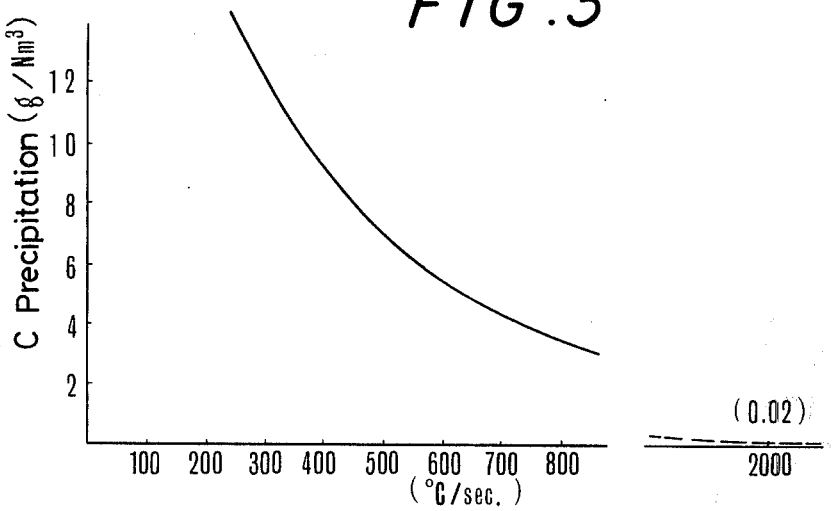
FIG. 3 is a diagram showing the relationship between the heating temperature of CO gas of 100 $Nm^3$ within the range of 500° –750°C when the same is heated to 800°C and the amount of soot separated from the gas.

The present inventors have noticed the increase in the separation of soot from the reducing gas within the heating range of 500° – 750°C and have carried out experiments in which the rate of raising the temperature of the gas is varied in order to find out the conditions under which the increase in soot separation is suppressed. FIG. 3 shows the relationship between the rate of raising the temperature of CO gas of 100 $Nm^3$ within the range of 500° – 750°C when the gas is being heated to 800°C and the amount of soot separated therefrom. As is clear from FIG. 3, the amount of soot separated from the gas decreases as the rate of raising the temperature of the gas is increased. The higher the rate of raising the temperature of the gas, the smaller the amount of soot separation from the gas. However, when the above described process of raising the temperature of the gas is carried out industrially, the rate of raising the temperature of the gas is limited from the economic point of view, such as, the heat resistance of the heating tube and the life thereof. When the reducing gas thus heated is used in the operation of the furnace, a certain amount of soot can be present in the gas without deteriorating its performance. For example, when the reducing gas is blown into a reducing furnace of iron oxide pellets, the degree of deterioration of the performance of the reducing furnace caused by the accumulation of soot in the various devices of the reducing furnace can be remarkably reduced if the amount of soot contained in the reducing gas is held to less than 10 $g/Nm^3$, preferably, less than 7 $g/Nm^3$, thereby permitting the reducing furnace to be operated without substantial hindrance of the operation. In case the reducing gas is preliminarily heated for reaction with a catalyst in order to regenerate the reducing gas, it is preferred to limit the amount of soot in the gas to below 200 $mg/Nm^3$.

In view of the above, the present invention comprises maintaining the rate of the temperature increases of the reducing gas higher than 500°C/sec. within the heating temperature range of 500° – 750°C when the reducing gas is being heated to a temperature higher than 500°C. As described previously, since the amount of soot separated from the reducing gas when heated varies depending upon the content of the CO component in the reducing gas, the rate of raising the temperature of the reducing gas within the above described range of the heating temperature is in general increased as the content of the CO component in the reducing gas increases. When a certain amount of components, such as, impurities, e.g., $CO_2$, $N_2$ and the like which affect the behaviour of the soot separation from the reducing gas when it is heated are included in the reducing gas, the rate of raising the temperature of the reducing gas is adjusted to a value higher than 500°C/sec.

By adapting the heating conditions of the reducing gas as described above, the amount of soot separated from the reducing gas can be reduced to an allowable range. However, as described previously, it is impossible to reduce the absolute amount of soot to zero.

Figure 4:
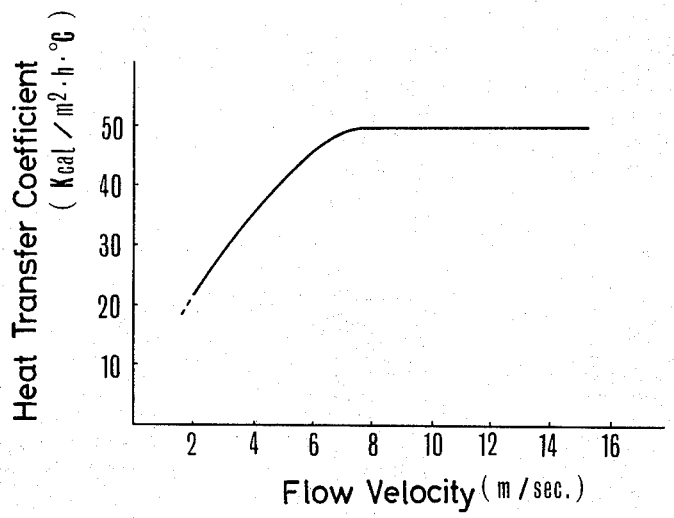
FIG. 4 is a diagram showing the relationship between the flow velocity of the reducing gas containing soot through a heating tube and the heat transfer coefficient thereof.

As was well known, when the temperature of the reducing gas is raised by using a heating tube, the efficiency of raising the temperature of the reducing gas varies as the diameter of the heating tube varies, and the efficiency is improved as the diameter of the tube is made smaller, if other conditions are the same. However, the troubles caused by soot inevitably generated during the heating of the reducing gas are made more serious as the diameter of the heating tube is made smaller when the amount of soot is constant. For example, soot adheres to the wall of the tube thereby lowering the heat transfer coefficient of the heating tube. Further, the soot tends to adhere more intensively to elbow portions, valve portions and like portions, of the tubing, thereby tending to cause blockage thereof. The adhesion of soot described above was found to be caused only depending upon the flow velocity of the gas containing soot under the dry condition. For example, when the gas containing soot of 10 $g/Nm^3$ is conveyed through a heat conducting tube so as to assure $h = 50$ $Kcal/m^2 \cdot h \cdot °C$ at various flow velocities under a clean condition, the heat transfer rate of the heat conducting tube deteriorates as shown in FIG. 4. In other words, the amount of soot of this type adhering to the tube wall tends to rapidly increase when the flow velocity is made less than 7 m/sec. According to the present invention, the flow velocity of the reducing gas is made higher than 7 m/sec. during the time the temperature of the same is being increased. As a result, the soot contained in the reducing gas tending to adhere to the tube wall and like surfaces is forced to move by virtue of the high flow velocity of the gas thereby substantially preventing the soot from adhering to the tube wall and surfaces so that the heat transfer rate of the heat conducting tube is not decreased.

Figure 5:
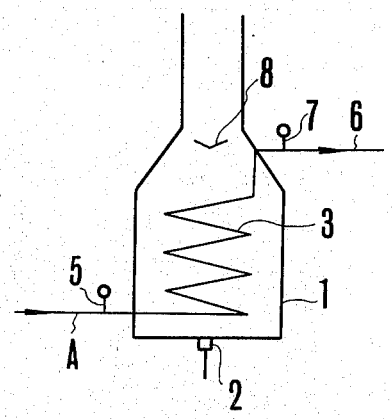
FIG. 5 is a schematic diagram showing the apparatus for carrying out the present invention.

Now, an example of the apparatus for carrying the method of the present invention will be described in connection with FIG. 5 illustrating the same. The heating apparatus shown in FIG. 5 is of an indirect heating furnace of the isoflow type. A gas burner 2 is located at the center of the bottom of the furnace 1. A heating tube 3 is arranged in the furnace 1. One end of the heating tube 3 is connected to a reducing gas supply tube 4 and a thermometer 5 is provided in the supply tube 4. The other end of the heating tube 3 is connected to a discharge tube 6 of the reducing gas which has been heated to a raised temperature in the furnace 1. A thermometer 7 is provided in the discharge tube 6. The amount of the fuel to be supplied to the gas burner 2 is determined by the aimed raised temperature of the reducing gas which is flown through the heating tube 3 at a set flow velocity. A reflecting plate 8 is provided in the furnace 1 as shown in FIG. 5.

EXAMPLE 1

A reducing gas ( $CO = 46.16\%$; $H_2 = 52.2\%$; $CO_2 = 0.06\%$; $N_2 = 0.47\%$ ) at the temperature of 30°C was flown through a heating tube having the diameter of 90 mm at the flow velocity of 25 m/sec. so that a reducing gas having the temperature of 800°C was obtained. The amount of the gas processed was 400 $Nm^3/h$. In the heating process described above, the rate of raising the temperature of the reducing gas within the raised temperature range of 500° – 750°C was set to 700°C/sec. As the result of the above process, the composition of the reducing gas of 800°C thus obtained was CO = 44.76%; $H_2$ = 53.09%; $CO_2$ = 0.20%; $N_2$ = 0.50%, and the amount of carbon separated from the reducing gas was 3.0 g/$Nm^3$. However, the heat transfer rate of the heating tube was not affected by the separated carbon (soot), and stable heating of the reducing gas was achieved.

EXAMPLE 2

A reducing gas ( CO = 42.94%; $H_2$ = 48.64%; $CO_2$ = 0.02%; $N_2$ = 8.35% ) at 200°C was introduced into an apparatus as shown in FIG. 5 in which 50 heating tubes each having the diameter of 25 mm were arranged so as to flow the reducing gas through the heating tubes at the flow velocity of 12 m/sec. thereby obtaining a reducing gas having the temperature of 800°C. The amount of the gas thus processed was 450 $Nm^3$/h. In the heating process described above, the rate of raising the temperature of the reducing gas within the raised temperature range of 500° – 750°C was set to 1000°C/sec. As a result of the above heating process, the composition of the thus obtained reducing gas having the temperature of 800°C was CO = 41.60%; $H_2$ = 49.07%; $CO_2$ = 0.07%; $N_2$ = 8.56%, and the amount of carbon (soot) separated from the reducing gas was 2 g/$Nm^3$. However, no blockage of the heating tubes took place and no substantial variation in the heat transfer rate of the heating tubes occurred so that a stable heating of the reducing gas was achieved.

As described above, the present invention provides a method of raising the temperature of a reducing gas containing a CO component to a temperature higher than 500°C wherein the temperature of the reducing gas is raised at a rate higher than 500°C/sec. when the gas is being heated in the temperature range, of 500° – 750°C in which range the separation of soot from the reducing gas is rapidly increased. Therefore, the present invention makes it possible to reduce the amount of soot separated from the reducing gas at least to 1/10 of the amount heretofore generated by the prior art heating systems for such reducing gas.

Further, since the flow velocity of the reducing gas is set to be higher than 7 m/sec. in accordance with the present invention, troubles, such as, the adhesion of soot inevitably generated during the heating of the reducing gas onto the tube walls and like portions and surfaces and, hence, the variation in the heat transfer rate of the heating tube and the blockage of the tubing system are positively eliminated. Thus, in accordance with the present invention, the stable heating of the reducing gas to a temperature higher than 500°C can be achieved without substantially deteriorating the performance of the reducing gas.

What is claimed is:

1. In a method for heating a reducing gas having CO as a component thereof to a temperature in excess of 500°C, the improvement which comprises heating the reducing gas at a rate greater than 350°/sec while the temperature of the gas is passing through the temperature range of 500°–750°C.

2. The method of claim 1 wherein the gas is heated by passing it over a heating surface at a flow velocity greater than 7m/sec.

3. The method according to claim 1 in which the reducing gas temperature is raised at a rate higher than 500°C/sec.

* * * * *